350-336 AU 257 [redacted]
PTU13 XR 4,077,032

United States Patent [19]

Volkman

[11] 4,077,032

[45] Feb. 28, 1978

[54] ELECTRONIC DISPLAY APPARATUS

[76] Inventor: Alan Volkman, 5331 Baltimore Ave., Chevy Chase, Md. 20015

[21] Appl. No.: 647,186

[22] Filed: Jan. 7, 1976

[51] Int. Cl.[2] ..... G04C 17/02

[52] U.S. Cl. ..... 340/324 R; 58/50 R; 58/4 A; 283/2; 340/378 R; D10/3; D10/31

[58] Field of Search ..... 340/324 R, 336, 378 R; 58/50 R, 4 A; 33/355, 325, 319; 283/2; D19/20; D10/15, 31, 3

[56] References Cited

U.S. PATENT DOCUMENTS

| | | | |
|---|---|---|---|
| 1,617,310 | 2/1927 | Sperry | 33/325 |
| 2,857,734 | 10/1958 | Weigenant | 33/355 |
| 3,540,209 | 11/1970 | Zatsky et al. | 58/50 R |
| 3,796,037 | 3/1974 | Fujita | 58/4 A |
| 3,844,105 | 10/1974 | Kashio | 58/50 R |
| 3,889,458 | 6/1975 | Kashio | 58/4 A |
| 3,945,190 | 3/1976 | Kimura et al. | 58/4 A |
| 3,959,963 | 6/1976 | Murrell | 58/50 R |

*Primary Examiner*—David L. Trafton
*Attorney, Agent, or Firm*—Wender, Murase & White

[57] ABSTRACT

Electronic display apparatus simulating a mechanical analog display for the portrayal of two or more measured variables includes an indicator assembly having a substrate supporting a plurality of optically variable elements, combinations of which enable the visual presentation of the measured parameters relative to a fixed scale or to each other. The apparatus is especially well suited for use as the time display of an electronic horological instrument either alone or together with a month and date digital display and/or a day of the week display which includes an array of seven indicators five of which are arranged to form a separately discernable group representing the days Monday, Tuesday, Wednesday, Thursday and Friday. The display apparatus is electronically driven and includes no moving parts.

16 Claims, 7 Drawing Figures

Fig. 1
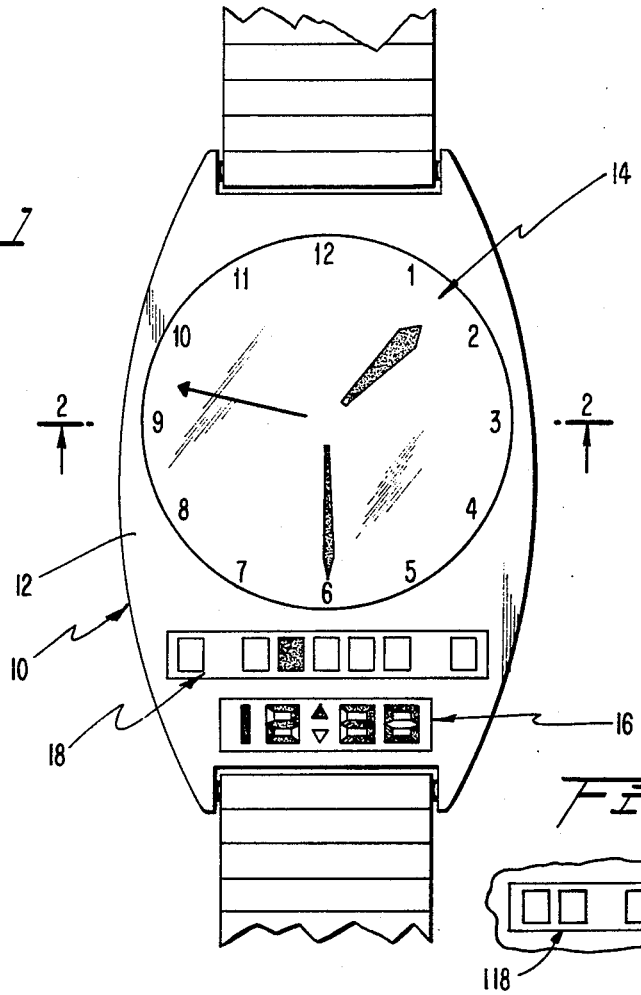
Fig. 10
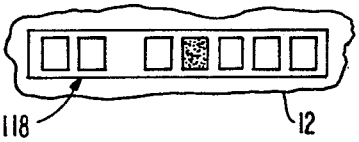
Fig. 2
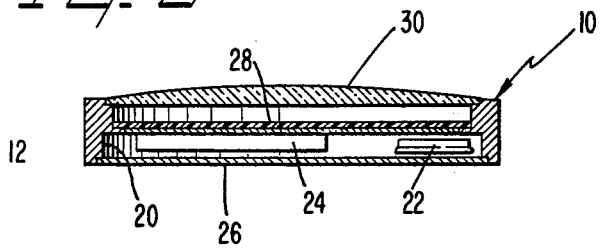
Fig. 11
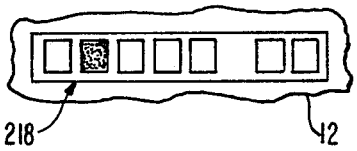
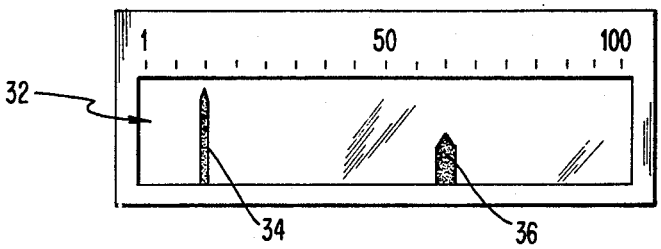
Fig. 3

42
SHIFT REGISTER
44
SHIFT REGISTER
46
SHIFT REGISTER
48
SHIFT REGISTER
50
52
54
56
40
A
B
C
D
E
F
G
H
I
J

44
SHIFT REGISTER
46
SHIFT REGISTER
48
SHIFT REGISTER
52
54
56
140
60
61
62
63
A
B
C
D
E
F
G
H
I
J

ELECTRONIC DISPLAY APPARATUS

BACKGROUND OF THE INVENTION

1. Field of the Invention

The present invention relates generally to display devices and, more particularly, to an electronic display formed of an array of optically variable indicators portraying the value of two or more measured parameters relative to a fixed scale or to each other.

2. Description of the Prior Art

Meters, mechanical pointers, dial displays, and similar display arrangements used to reflect a measured parameters have long been known. In the past, and to a great extent continuing to the present, most such display or indicator devices were mechanical in nature and included one or more pointers or dials to register the value of the measured input. With the development of light emitting diodes, liquid crystal display elements, and the like, digital format electronic displays are available and compatibly form total electronic measuring and indicating assemblies having no moving parts.

The above displays provide a digital readout, thus, are primarily useful for applications where precision and accuracy in the readout of the measured parameter are required. In many instances, however, an analog output is preferred. In those situations, even though the driving circuits may be produced using sophisticated integrated circuit techniques, the actual display elements typically remain mechanical in nature with the result that the overall system suffers from all of the inaccuracies and limitations inherent in such mechanical assemblies.

Following the pattern of development of the general display art, is the development of solid state, electronic watches and other horological instruments for the display of time. In such cases, the segmented digital display is popularly employed in place of conventional mechanical hands; however, this practice requires the watch bearer to learn to accept a new format for the presentation of the current time as well as the passage of time. On the other hand, the conventional analog presentation permits the watch owner to automatically conceptualize furture or past time by direct visual comprehension without having to make a mental arithmetic computation as is the case with digital format.

Thus, while the total electronic driving circuit is preferred in watches and other indicators because of its inherent accuracy and small size, the conventional mechanical analog presentation is also preferred because of the enhanced visual comprehension provided by such a readout as compared with the digital format. In the past, this preference has required that electrical output signals be converted into mechanical movements of the pointers of the short and long hands, resulting in a complicated structure necessitating a direct electrical-mechanical interface with associated disadvantages. Consequently, considerable design effort has been spent in an attempt to develop a total electronic display having an analog readout.

The prior art, as exemplified by U.S. Pat. Nos. 3,275,871 and 3,833,933, is generally cognizant of solid state display assemblies which attempt to simulate the movement of a mechanical pointer. In addition, U.S. Pat. Nos. 3,276,200, 3,540,209, 3,823,549, 3,844,105, and 3,908,355, represent a number of prior art attempts to incorporate total electronic analog indicators in a timekeeping instrument. White these devices have obviated the necessity for mechanical pointers or hands, they have not proven to be totally satisfactory in that the display does not fully simulate the appearance of the more familiar mechanical pointer or hands and involves considerable complexity in attempting to facilitate the measurement of two or more indendent parameters.

SUMMARY OF THE INVENTION

It is, therefore, an object of the present invention to privide an electronic analog display capable of indicating unambiguously two or more independent measured parameters.

The present invention has a further object in the provision of a day of the week indicator which is language and culture independent.

Another object of this invention is to provide a total electronic timepiece display having the appearance of conventional watch hands.

The present invention is summarized in a display assembly which includes a plurality of optically variable indicators arranged in an array, a driving circuit for a first set of the indicators to visually represent a first measured parameter, a driving circuit for a second set of the indicators to visually represent a second measured parameter, and wherein at least one of the indicators of the first and second sets are common to both sets.

The present invention is further summarized in that a day of the week display includes an array of seven indicators, five of the indicators being arranged apart from the remaining two indicators to form a discernable group representing the days Monday, Tuesday, Wednesday, Thursday and Friday, respectively, the remaining two indicators representing the days Saturday and Sunday.

This invention exhibits a number of advantages over prior art displays in that the electrical-mechanical innerface is eliminated, that two or more parameters may be simultaneously displayed without interference or ambiguity, that all electronic indicators are coplanar to eliminate multi-plane parallax, that failure of one segment will not cause the inaccurate display of information such as that which occurs when a segment of a digital indicator fails, that accurate simulation of conventional pointers or hands is provided, and that language and culture independent display of time of day and day of the week may be provided.

Other objects and advantages of the present invention will become apparent from the following description of the preferred embodiments when taken in conjunction with the accompanying drawings.

BRIEF DESCRIPTION OF THE DRAWINGS

FIG. 1 is a top plan view of a preferred embodiment of a display according to the present invention in a timepiece;

FIG. 2 is a sectional view taken along line 2—2 of FIG. 1;

FIG. 3 is a plan view of another embodiment of the display of the present invention for indicating two or more parameters on a percentage scale;

FIGS. 10 and 11 are partial top plan views showing modifications of the day of the week indicator according to the present invention.

DESCRIPTION OF THE PREFERRED EMBODIMENTS

Figure 4:
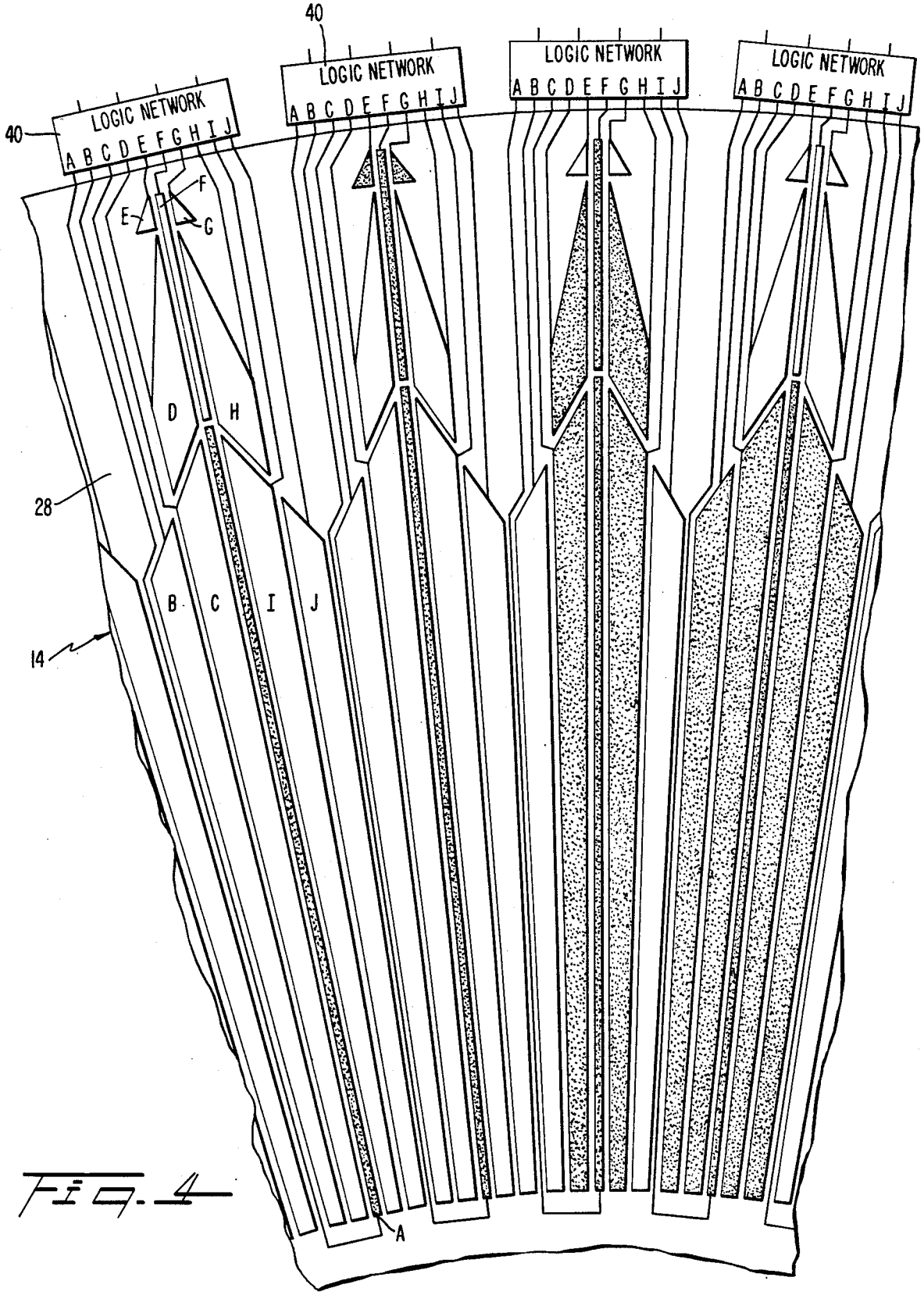
FIG. 4 is a partial diagrammatic view, in plan, of the display face of the timepiece of FIG. 1.

Referring to FIG. 1, a preferred embodiment of a display for a timepiece 10 according to the present invention has a casing or housing 12 on which are mounted a first display assembly 14 for providing an analog portrayal of hours and minutes, a second display assembly 16 for digitally indicating the month and date and for providing an indication of "AM" or "PM", and a third display assembly 18 for indicating the day of the week. As shown in FIG. 2, casing 12 may be provided with a suitable cavity 20 in which are mounted a power source such as a battery 22 as well as electrical counting and driving circuits 24 for the various display assemblies. Cavity 20 may be provided with a suitable cover 26 having an easily removable access door (not shown) to enable the replacement of the battery 22, as necessary. The display assembly 14 includes a substrate 28 on which are mounted a series of optically variable indicators, as will be more fully described below, and a watch crystal 30 is mounted over substrate 28 on the casing 12.

Each of the display assemblies 14, 16 and 18 may be constructed in a similar fashion and may consist of any number of indicator devices or elements such as liquid crystal devices, electroluminescent panels, light emitting diodes, optically variable magnetic fluid devices, fiber optics, edge lighted plastic elements, crystal diffusion reflection devices, and the like. All of these different devices are well known in the art, and a detailed description of each is not provided for the sake of brevity. It is noted, however, that in certain instances, it is necessary to provide a return electrode, that is, two electrodes ae necessary, such as is the case with liquid crystal devices. In these cases, crystal 30 may be provided with a transparent electrically conductive coating on its inner surface and the liquid crystal medium may be contained within the space between substrate 28 and the crystal 30.

It should be appreciated from the outset that the present invention is useful in many applications in addition to the display of time. As shown in FIG. 3, for example, a linear display assembly 32 constructed in the same manner as display 14 is provided for cooperation with a scale indicating percentage of a measured parameter. As will be more fully appreciated from the detailed description below, the present invention enables the unambiguous display of a number of different measured parameters by providing on the display substrate a plurality of separate indicator elements, first and second sets or groups of which may be separately driven so as to form discernable patterns simulating conventional mechanical hands.

In FIG. 1, for instance, the two sets of indicators are arranged and configured such that a pictorial representation of conventional hour and minute hands is provided. In FIG. 3, a first set of indicators may be driven to depict a relatively thin, long pointer 34 whereas a second set may be driven to depict a relatively short, wide pointer 36. Of course, the principles of the present invention may be readily expanded to enable presentation of more than two parameters, as can be appreciated from FIG. 1 wherein a third set of indicators is separately driven to depict movement of a second "hand."

While the present invention has a general applicability, as noted above, the description will be directed to particular applications of the present invention in the formation of a timepiece assembly and a compass assembly, solely for purposes of clarity and brevity.

Turning now to FIG. 4, substrate 28 of the first display assembly 14 is preferably divided into sixty pie-shaped sections of which four are partially illustrated. In each of the sixty areas, ten electrode segments A through J are provided, as shown. Electrodes A and F are respectively long and short elongated rectangular areas disposed along a radial line in the middle of each of the sixty areas. Additional electrodes C and I are disposed on each side of electrode A and, in turn, electrodes B and J are disposed on each side of electrodes C and I, respectively. Similarly, electrodes D and H are disposed on either side of electrode F, and triangular electrodes E and G are disposed on each side of electrode F at the extreme outer end thereof.

Each of the electrodes A through J are connected by appropirate electrical leads to outputs A through J respectively, of a series of identical logic networks 40, a separate logic network provided for each group of ten electrodes in the sixty designed areas of substrate 28.

As described above, each of the electrode segments A through J may be formed of any suitable electronic elements responsive to an input signal to optically change states so as to provide a perceptible indication. The ten elements in each pie-shaped area may be considered to form a group. By dividing the indicators into sub-sets or sub-groups, different parameters may be displayed without ambiguity and without interference. For example, by actuating a sub-group comprising elements A, E, F, and G, a thin arrow is displayed and may be used to indicate "seconds." Thus, the sub-group of indicators A, E, F, and G represent the parameter "seconds." Similarly, by activating electrodes A, C, D, F, H, and I, a display simulating the appearance of a conventional minute hand is provided. Thus, elements C, D, F, H, and I represent a different sub-group for the parameter "minutes." In like manner, the sub-group of elements B, C, A, I, and J is used to depict the parameter "hours" and provides a visual representation of a conventional hour hand.

The display may also be visualized as comprising a first set of elements consisting of all of the elements on the substrate, and a second set of elements consisting of all of the elements below the zigzag dividing line; i.e., all elements labeled A, B, C, I and J. In each of these sets, a sub-set of elements may be activated to depict a uniquely shaped pointer. For example, to depict a minute hand, a first sub-set consisting of elements A, C, D, F, H and I of the first set would be activated. Likewise, to depict an hour hand, a second sub-set consisting of elements A, B, C, I and J in the second set would be activated.

At this point, it is noted that the various electrodes may be provided on substrate 28 using a number of well known techniques. For example, the electrodes and the electrical leads may be vacuum deposited or photographically formed directly onto or in the substrate in a simple and straightforward manner. Depending upon the resolution accuracy of the particular techniques employed in manufacturing the display and the particular type of indicator elements selected, electrodes A, B, C, I and J of each group may be extended nearly to the center of substrate 28 so as to depict the actual appearance of conventional mechanical hands. Alternatively, and depending upon the overall design desired, electrodes A, B, C, I, and J may terminate on the circumference of a circle as shown in FIG. 4.

Figure 5:
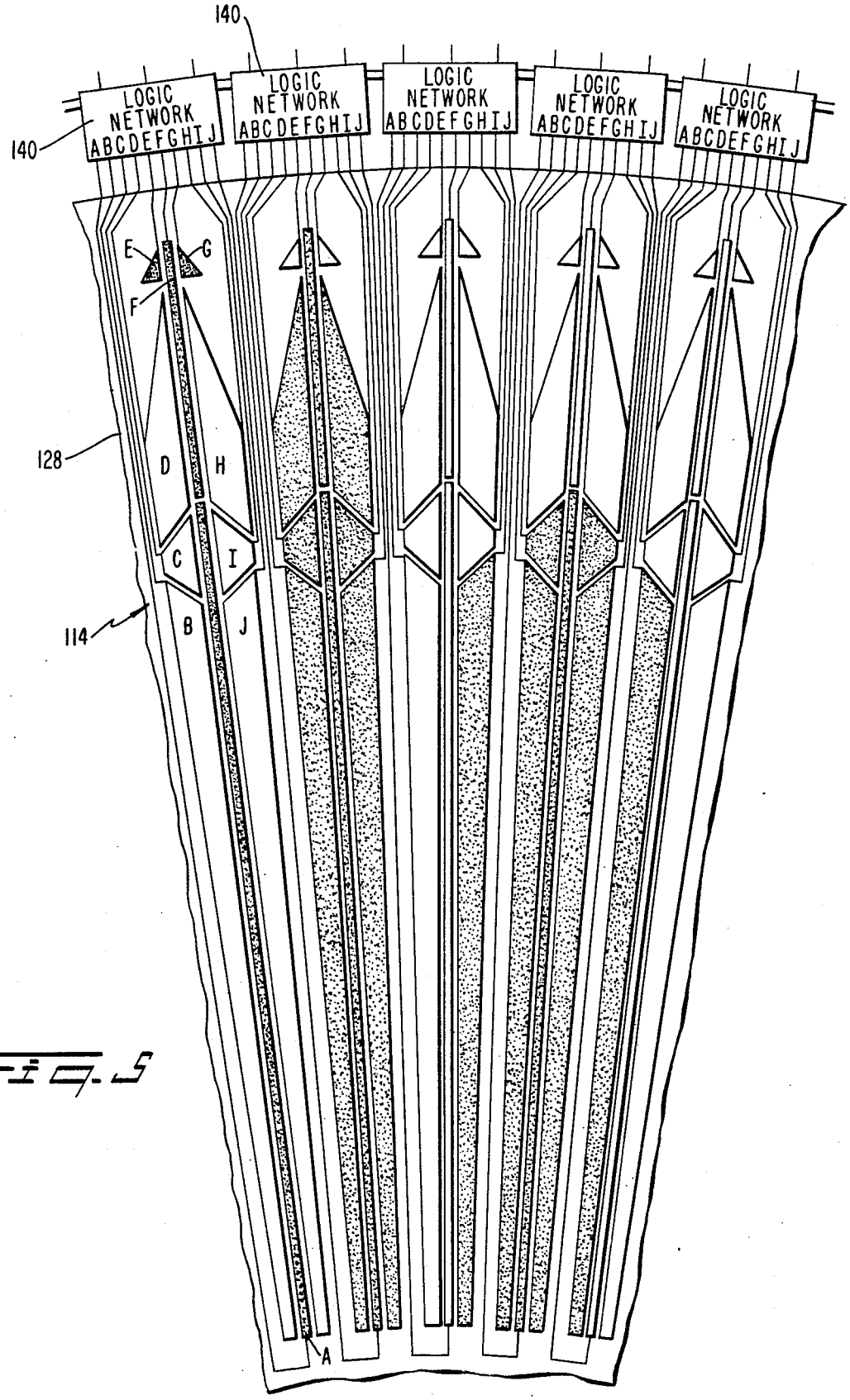
FIG. 5 is a view similar to FIG. 4 showing another embodiment of the display according to the present invetnion.

A modification of the pattern of FIG. 4 is illustrated in FIG. 5. In FIG. 5, electrodes B and C are radially arranged along one side of electrode A while electrodes A and I are similarly arranged along the opposite side. In the modification FIG. 5, electrodes C and I are approximately trapezoidal in shape and are quite short in comparison to the corresponding electrodes of the modification of FIG. 4.

In FIG. 5, the electrode pattern is formed on a substrate 128 to form a display assembly 114 similar to substrate 28 and display assembly 14 of the embodiment of FIG. 4. Each set of electrodes A through J are also driven by logic networks 140 via suitable electrical leads. In FIG. 5, the pattern is such that a greater degree of indicator resolution is possible since the electrodes A through J are more narrowly formed on the substrate allowing additional groups to be provided in the same space occupied by the electrodes A through J in the embodiment of FIG. 4.

In the modification of FIG. 5, each of the logic networks 140 are interconnected with each other so as to drive simultaneously certain indicator electrodes of each group as well as selected ones of each adjacent group at the same time to depict one or more of the measured parameters. In the illustrated example, electrodes A, B, C, I, and J of one group are simultaneously energized with electrode J of the preceding group and electrode B of the following group to portray a conventional hour hand. This sub-group of elements thus represents the parameter "hours." The sub-group representing the parameter "seconds" is the same for both displays 14 and 114; while the "minutes" sub-group is formed of elements A, B, C, E, F, H, I and J.

Figure 6:
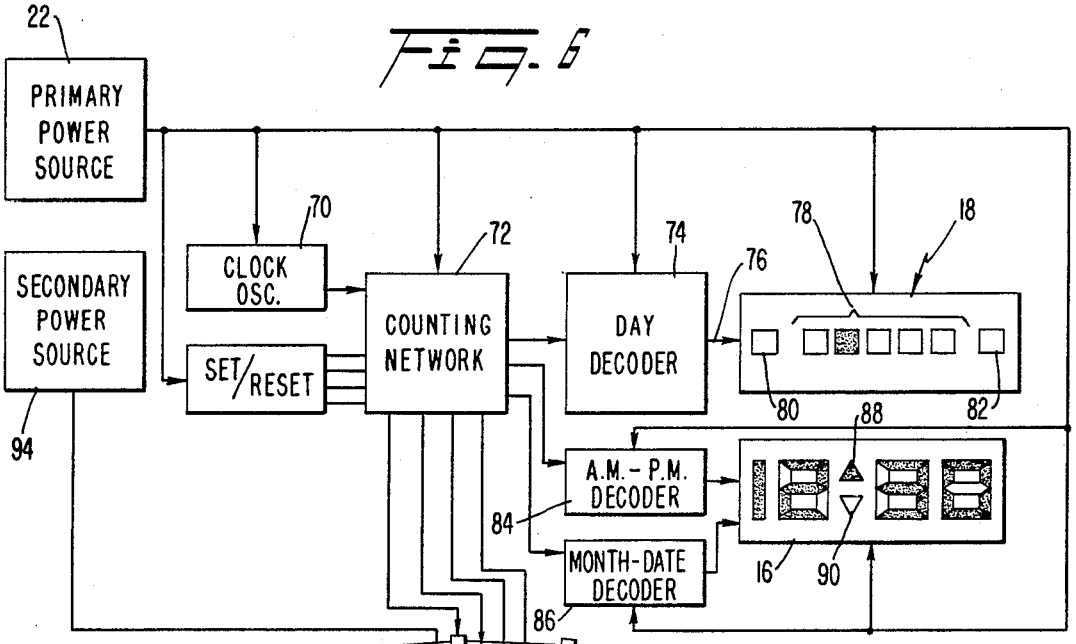
FIG. 6 is a schematic diagram, in block form, of the driving circuits of the timekeeping assembly of FIG. 1.
Figure 7:
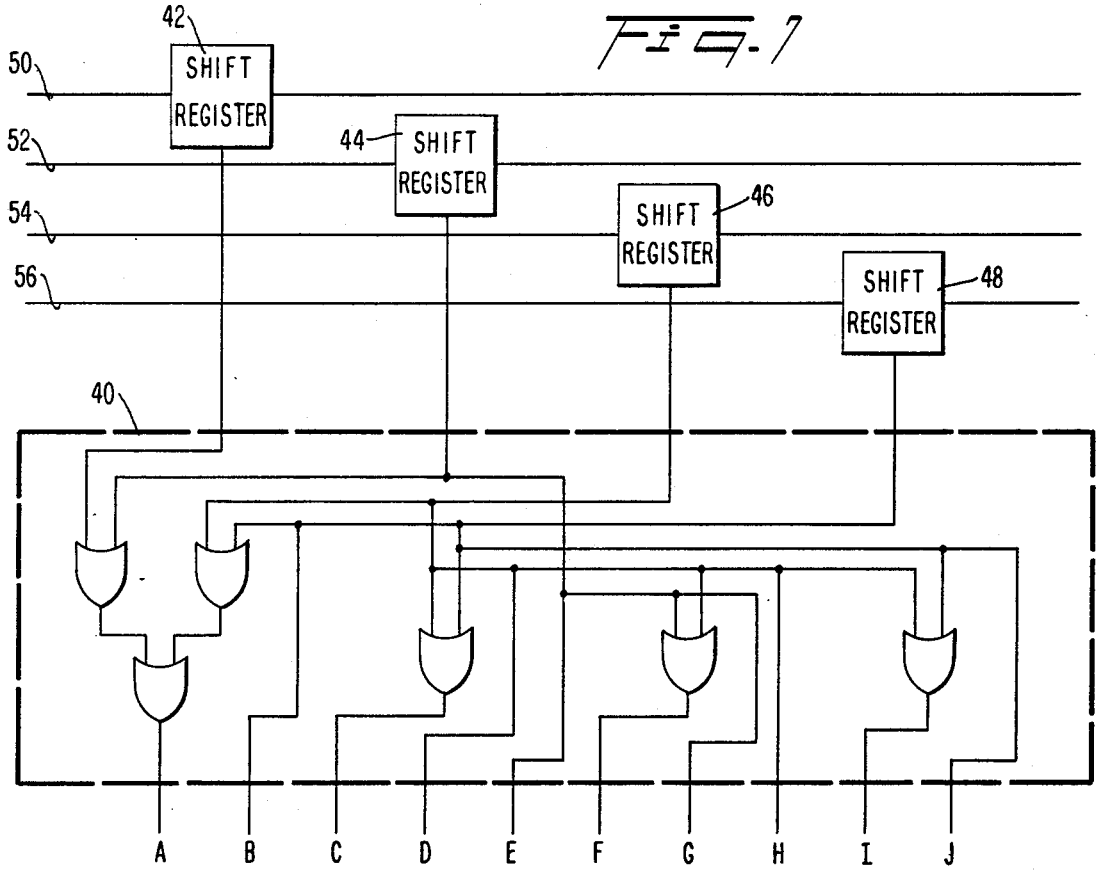
FIG. 7 is a block diagram of the addressing and logic networks of the circuit of FIG. 6 for driving the display of FIG. 4.

FIG. 7 illustrates the addressing and logic networks used to drive the display of FIG. 4. Associated with each of the logic networks 40 is a set of shift registers, reversible drivers or other appropriate addressing and sequencing circuits 42, 44, 46 and 48. Each of these addressing circuits is interposed in a respective sequencing ring 50, 52, 54 and 56. As described below in connection with FIG. 6, rings 50-56 are respectively provided with signals from a counting circuit corresponding to (a) hours in a different time zone, (b) seconds, (c) minutes, and (d) hours, respectively. Each time a pulse is received on one of the rings, an addressing circuit or shift register in that ring provides an output signal to its corresponding logic network 40. A subsequent pulse on that ring causes the shift register to remove the signal to logic means 40 and to trigger the next succeeding shift register in that ring for providing a signal to the next succeeding logic circuit 40. In this manner, counting pulses applied to the rings 50–56 are sequenced through the addressing networks for the application of energizing pulses to logic networks 40 in clockwise sequence.

As shown in FIG. 7, each of the logic networks 40 is comprised of a number of "OR" logic gates or their functional equivalent. The logic gates are interconnected according to the following truth table where a "1" indicates the presence of an input or output pulse:

| Input | | | | | Output | | | | | | | | | |
|---|---|---|---|---|---|---|---|---|---|---|---|---|---|---|
| 50 | 52 | 54 | 56 | : | A | B | C | D | E | F | G | H | I | J |
| 1 | 0 | 0 | 0 | : | 1 | 0 | 0 | 0 | 0 | 0 | 0 | 0 | 0 | 0 |
| 0 | 1 | 0 | 0 | : | 1 | 0 | 0 | 0 | 1 | 1 | 1 | 0 | 0 | 0 |
| 0 | 0 | 1 | 0 | : | 1 | 0 | 1 | 1 | 0 | 1 | 0 | 1 | 1 | 0 |
| 0 | 0 | 0 | 1 | : | 1 | 1 | 1 | 0 | 0 | 0 | 0 | 0 | 1 | 1 |

Figure 8:
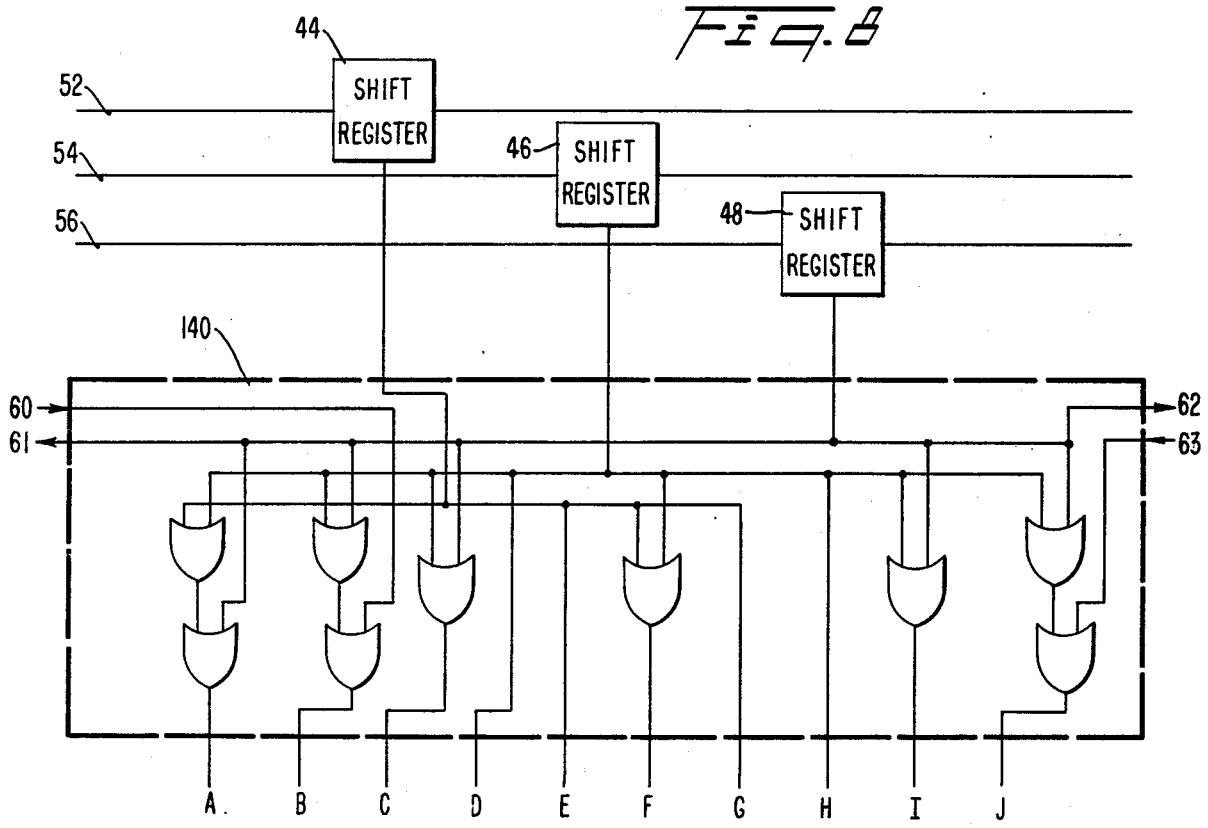
FIG. 8 is a block diagram of the addressing and logic networks of the circuit of FIG. 6 for driving the display of FIG. 5.

FIG. 8 is a block diagram of the address and logic networks used in the circuit of FIG. 6 for driving the display of FIG. 5. The construction and function of the network of FIG. 8 is generally similar to that of FIG. 7 with the exception that each of the logic networks 140 are connected to the preceding and succeeding adjacent logic networks by lines 60–61 and 62–63, respectively. It is also noted that the logic network 140 is shown as being driven by shift registers from only three rings 52–56; although, it should be understood that any number of additional rings or additional input combinations may be provided as required to effectuate the desired display pattern. As shown in FIG. 6, for example, network 140 (or network 40 of FIG. 4) may be configured to display a fixed indicator 65, to serve as an alarm.

The logic networks 140 operate according to the following table where again a "1" indicates the presence of an input or output pulse:

| Input | | | | | Output | | | | | | | | | | | |
|---|---|---|---|---|---|---|---|---|---|---|---|---|---|---|---|---|
| 63 | 60 | 52 | 54 | 56 | : | 61 | A | B | C | D | E | F | G | H | I | J | 62 |
| 1 | 0 | 0 | 0 | 0 | : | 0 | 0 | 0 | 0 | 0 | 0 | 0 | 0 | 0 | 0 | 1 | |
| 0 | 1 | 0 | 0 | 0 | : | 0 | 0 | 1 | 0 | 0 | 0 | 0 | 0 | 0 | 0 | 0 | 0 |
| 0 | 0 | 1 | 0 | 0 | : | 0 | 1 | 0 | 0 | 0 | 1 | 1 | 1 | 0 | 0 | 0 | 0 |
| 0 | 0 | 0 | 1 | 0 | : | 0 | 1 | 1 | 1 | 1 | 0 | 1 | 0 | 1 | 1 | 1 | 0 |
| 0 | 0 | 0 | 0 | 1 | : | 1 | 1 | 1 | 1 | 0 | 0 | 0 | 0 | 0 | 1 | 1 | 1 |

Turning now to FIG. 6, the display according to the present invention, when utilized in a timepiece, is operated from a primary power supply such as battery 22 which supplies operating potential to the various logic and display networks. A digital input source representing a measured parameter to be displayed is represented by block 70 which, in a timepiece, is preferably a high frequency clock oscillator such as a piezoelectric quartz crystal. The output of the clock oscillator 20 is fed to a counting network 72 which provides output pulses at predetermined divisions of the frequency of input pulses from source 70. For a timepiece, the counting network 72 includes a plurality of counter stages to provide output pulses at the frequencies of one each second, one each minute, one each 12 hours, and one each 24 hours. These output signals constitute the different parameter variables to be displayed by assembly 14.

The output signals from counting network 72 are fed to a "day" decoder-driver circuit 74 which provides an output signal on line 76 once each day. This signal is used to drive the day of the week indicator 18 through an appropriate shift register or other sequencing logic network. The day of the week indicator 18 is formed of seven separate electrodes or indicators preferably constructed in the same manner as the hour and minute displays illustrated in FIGS. 4 and 5. Five of the indicators 78 are grouped together to form a separately discernable group representing the days Monday, Tuesday, Wednesday, Thursday and Friday. The remaining two indicators represent the days Saturday and Sunday and are disposed in spaced relationship from the five indicators 78. The indicators 80 and 82 representing the days Sunday and Saturday, respectively, may be disposed one on each side of the group 78, as shown in FIG. 6, or may be grouped together on the either side of the group 78. These modifications, according to the present invention, are shown in FIGS. 10 and 11 as displays 118 and 218, respectively.

As each input signal is received from the days decoder-driver 74 on line 76, a successive one of the seven electrodes of indicator assembly 18 is caused to depict the particular day of the week. As illustrated, for example, display assembly 18 represents the day "Tuesday" since the second indicator of the group 78 is activated or energized. The day of the week indicator assembly according the present invention is particularly advantageous in that it is language and culture independent and requires no identifying labeling or symbols to differentiate or denote the designated day. It is noted that the day of the week indicator may be provided as a separate display and may incorporate any number of different indicator elements such as discrete lamps, different colored replaceable cards, LED's, etc.

Other outputs of the counting network 72 are fed to an AM-PM decoder driver 84 and a month-date decoder driver 86 which feed the display assembly 16. Display assembly 16 portrays the month and date in digital format, with the month and date characters separated by an upwardly pointing triangular electrode 88 and a downwardly pointing electrode 90. Electrode 88 when energized, indicates that the time displayed by display assembly 14 is "AM" whereas energizing of electrode 90 indicates "PM". As with the day of the week display 18, the AM-PM indicators 88 and 90 are language and culture independent.

The primary counting outputs of counting network 72 are fed to the addressing and sequencing rings 53–56 to sequentially drive the electrodes of the display assembly 14, as described above. Further, additional switching circuits 92 may be provided between the outputs of logic networks 40 and the display electrodes for enabling the driving of the display from a secondary source 94. Secondary source 94 need not be similar to source 22 and, for example, may be a fluidic source to drive fluidic display elements or may be an a.c. source to drive a relatively large display. Also, the secondary source 94 may be utilized as a supplemental power source during time intervals when additional brightness in the display output is necessary, thereby to relieve excessive drain from the primary source 22.

Figure 9:
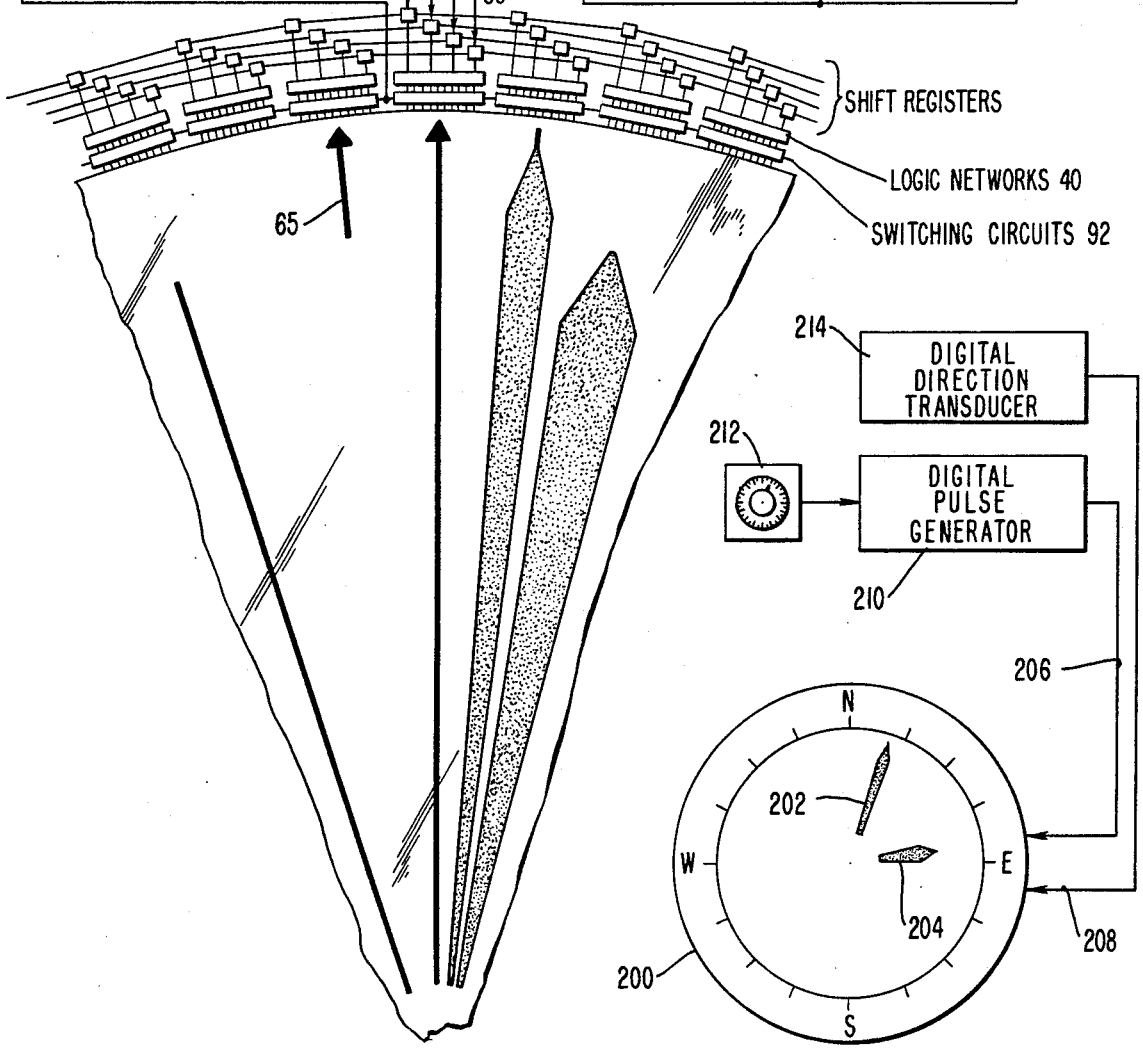
FIG. 9 is a diagrammatic view of a further embodiment of the display according to the present invention in a compass.

Referring to FIG. 9, a compass assembly 200 is provided having a display assembly similar to display 14 of FIG. 1 and incorporating a pattern of indicator elements as shown in FIGS. 4 or 5. A set of elements corresponding to the set forming the minute hand of the timepiece of FIG. 1 is used to provide an indicator "pointer" 202 to denote a desired or preset compass heading. Similarly, a "pointer" 204 corresponding to the hour hand of the timepiece of FIG. 1 is used to denote the actual compass bearing.

In the same manner as shown in FIGS. 4, 5 and 6, a plurality of addressing circuits and logic networks are interconnected to form two input "rings" for driving the "hands" 202 and 204. The input "rings" for pointers 202 and 204 are supplied with input pulses over lines 206 and 208, respectively. The signals fed over line 206 are derived from a digital pulse generator 210 which is manually controllable or adjustable by a suitable selector switch 212. The signals on line 208 are derived from a digital direction transducer 214 which may be of any suitable design for converting actual compass bearing information to digital format.

In operation, switch 212 is adjusted so as to condition generator 210 for the development of a digital pulse signal on line 206. This signal causes the energization of a particular sub-set of indicator elements causing pointer 202 to point in the direction corresponding to that preselected by switch 212. Thereafter, digital signals corresponding to actual compass bearings provided by transducer 214 will be fed along line 208 to cause indicator 204 to display real time compass bearing information. By virtue of the simultaneous display of desired and actual compass bearing readings, the error or difference between the two readings may be readily visualized.

As can be appreciated from FIG. 9, the display according to the present invention is readily adaptable to any number of applications in addition to the timepiece of FIG. 1 and the percentage indicator of FIG. 3. Furthermore, the compass assembly of FIG. 9, the timepiece of FIG. 1, and the percentage indicator of FIG. 3 require no mechanical or moving parts and thereby enable the total electronic configuration of the assembly and the elimination of problems associated with electrical-mechanical interfacing at the display.

It can be appreciated from the foregoing that the present invention allows a plurality of coplanar distinctively shaped electrodes to point to various positions on the fixed display scale while maintaining their individual identities in an unambiguous form. The apparatus provides for the analog display of any appropriate measured parameter in that the electrode patterns simulate conventional pointers or hands. At the same time, the apparatus is "digital" in the sense that the position of each indicator varies by a predetermined discrete amount relative to the fixed display scale or to a second indicated parameter. The display assembly according to the present invention is adapted to portray any number of measured input parameters and obviates the necessity of interfacing the electrical measuring circuitry with a conventional mechanical pointer or hand analog display. The display is also not limited to any particular size and may be used equally well as a small display for a watch or compass or as a large display for indicating, for example, arrivals and departures at an airport.

Inasmuch as the present invention is subject to many variations, modifications and changes in detail, it is intended that all matter contained in the foregoing description or shown in the accompanying drawing shall be interpreted as illustrative and not in a limiting sense.

What is claimed is:

1. A display assembly, comprising:

a substrate;

a plurality of optically variable indicators on said substrate arranged in an array, said indicators being grouped in first and second sets in said array;

means for driving a first sub-set of said first set of indicators to form a visually discernable pointer having a first shape and representing a first measured parameter;

means for driving a second sub-set of said second set of indicators to form a visually discernable pointer having a second shape and representing a second measured parameter;

said first and second shapes being such that they are separately discernable when superimposed;

at least one but not all of said indicators of said first and second sets being common to both sets.

2. A display assembly as recited in claim 1 wherein said plurality of indicators comprise coplanar electro-optical elements.

3. A display assembly as recited in claim 1 wherein said first and second driving means generate electrical output signals; and wherein said indicators are electrically responsive to said signals and have at least two optically variable states.

4. A display assembly as recited in claim 1 wherein said first set of indicators comprises a plurality of identical adjacent first sub-sets of indicators; and wherein said second set of indicators comprises a like plurality of identical, adjacent second sub-sets of indicators; each of said sub-sets of said first and second sets of indicators, respectively, being disposed in partial coincidence on said substrate.

5. A display assembly as recited in claim 4 wherein each sub-set of indicators corresponds to a predetermined value of a measured parameter; and wherein said first and second driving means comprise means responsive to said first and second measured parameters, respectively, for generating first and second digital outputs; and sequencing means coupled between said generating means and said first and second sets of indicators, and reponsive to said first and second digital outputs for driving the sub-set of each of said first and second sets of indicators, respectively, corresponding to the value of said first and second measured parameters.

6. A display assembly, comprising a substrate;

a plurality of identical coplanar groups of optically variable indicators on said substrate arranged adjacent each other in an array for cooperation with a scale;

each of said groups of indicators being divided into a plurality of sub-groups of multiple indicators, at least one but not all of said indicators of each sub-group within each group being common to all sub-groups of that group;

the indicators of each group being geometrically shaped such that each sub-group of indicators forms a differently shaped pointer whereby said pointers may be separately discerned when plural sub-groups within a group are simultaneously driven; and means for driving said sub-groups in response to measured parameters whereby plural measured parameters may be independently displayed.

7. A display assembly for a timepiece, comprising:

a clock circuit for generating an output each minute and an output each hour;

a substrate;

a first set of indicators arranged in a radial pattern on said substrate;

a second set of indicators arranged in a radial pattern on said substrate;

at least one but not all of said indicators being common to both sets;

first driver means coupled between said clock circuit and said first set of indicators for driving a sub-set of said first set of indicators to simulate the appearance of a mechanical minute hand in response to minute outputs from said clock circuit;

second driver menas coupled between said clock circuit and said second set of indicators for driving a sub-set of said second set of indicators to simulate the appearance of a mechanical hour hand in response to hour outputs from said clock circuit; and said sub-sets of said first and second set of indicators being shaped such that said simulated hour and minute hands may be separately discerned when superimposed.

8. A display assembly for a timepiece as recited in claim 7 wherein said clock circuit generates an output each second; and further including a third set of indicators arranged in a radial pattern on said substrate, at least one but not all of said third set of indicators being common to said first and second sets; and third driver means coupled between said clock circuit and said third set of indicators fcr driving a sub-set of said third set of indicators to simulate the appearance of a mechanical second hand in response to second outputs from said clock circuit.

9. A display assembly for a timepiece as recited in claim 7 wherein said indicators are coplanar.

10. A display assembly for a timepiece as recited in claim 7 further including circuit means coupled between said clock circuit and said driver means for driving at least one indicator in predetermined fixed relationship with said driven group of said second set of indicators to indicate the hour in a preselected different time zone.

11. A display assembly for a timepiece as recited in claim 7 further including network means coupled to said indicators for driving at least one of said indicators to indicate a preselected fixed time.

12. A display assembly for a timepiece as recited in claim 7 wherein said clock circuit generates an output each day and an output each month; and further including means for displaying an indication of the month, date and day of the week.

13. A day of the week display, comprising:

a rectilinear array of seven electro-optical indicators having no indicia;

five of said indicators being equally spaced apart from each other to form a group representing from left to right the days Monday, Tuesday, Wednesday, Thursday and Friday, respectively;

the remaining two indicators being disposed one on each side of said group, each at a distance from its next adjacent indicator greater than the distance between the indicators of said group such that said group may be separately discerned apart from said remaining two indicators, said remaining two indicators representing the days Sunday and Saturday, respectively; and a clock circuit generating an electrical output each day and cooperating with said seven indicators for driving each of said indicators in timed sequence to effect an indication of the day of the week whereby the day of the week may be displayed without the use of indicia.

14. A display assembly as recited in claim 6, wherein said plurality of identical coplanar groups comprise at least sixty pie-shaped groups arranged in a radial array, each group containing ten electro-optical indicator elements.

15. A display assembly as recited in claim 14, wherein said ten elements of each group comprise:

a first elongated rectangular element disposed along a radial line bisecting said group;

a second elongated rectangular element shorter in length than said first rectangular element and disposed in an outer radial position adjacent said first rectangular element along said radial line;

a first pair of polygonal elements disposed one on each side of said first rectangular element;

a second pair of polygonal elements disposed one on each side of respective ones of said first pair of polygonal elements;

each element of said first and second pairs of elements having first and second radial edges, an inner edge generally normal to said radial edges, and an outer edge angled toward said radial line going in a radially outward direction;

a third pair of polygonal elements disposed one on each side of said second rectangular element;

each element of said third pair of elements having first and second radial edges, and inner and outer edges angled toward said radial line going in a radially outward direction; the inner edge of each element being adjacent and parallel to the outer edge of a respective one of said first pair of polygonal elements; and a pair of triangular electrodes disposed one on each side of said second rectangular element adjacent the radially outermost end thereof and cooperating with said second rectangular element to form an arrow-head therefor;

said first rectangular element and said first and second pairs of polygonal elements comprising a first sub-group; said first and second rectangular elements and said first and third pairs of polygonal elements comprising a second sub-group; and said first and second rectangular elements and said pair of triangular elements comprising a third sub-group.

16. A display assembly, comprising a substrate;

at least sixty identical coplanar groups of electro-optical indicator elements arranged adjacent each other in a radial array for cooperation with a scale;

each of said groups containing:

a first elongated rectangular element disposed along a radial line bisecting said group;

a second elongated rectangular element shorter in length than said first rectangular element and disposed in an outer radial position adjacent said first rectangular element along said radial line;

a first pair of polygonal elements disposed one on each side of said first rectangular element;

a second pair of polygonal elements disposed one on each side of said first rectangular element;

a third pair of polygonal elements disposed one on each side of said second rectangular element; and a pair of triangular electrodes disposed one on each side of said second rectangular element adjacent the radially outermost end thereof and cooperating with said second rectangular element to form an arrow-head therefor;

means for driving said first rectangular element said first and second pairs of polygonal elements, and an adjacent element of the first pair of elements of each adjacent group to form a visually discernable pointer having a first shape and representing a first measured parameter;

means for driving said first and second rectangular elements and said first, second and third paris of polygonal elements to form a visually discernable pointer having a second shape and representing a second measured parameter; and means for driving said first and second rectangular elements and said pair of triangular elements to form a visually discernable pointer having a third shape and representing a third measured parameter;

said first, second and third shapes being such that they are separately discernable when superimposed.

* * * * *